US006464086B1

(12) United States Patent
Klein et al.

(10) Patent No.: US 6,464,086 B1
(45) Date of Patent: Oct. 15, 2002

(54) HANGING MODULAR STORAGE UNIT

(75) Inventors: Richard B. Klein, Overland Park; Chris Serslev, Leawood; John W. Scott, Lenexa, all of KS (US)

(73) Assignee: Lynk, Inc., Lenexa, KS (US)

( * ) Notice: Subject to any disclaimer, the term of this patent is extended or adjusted under 35 U.S.C. 154(b) by 0 days.

(21) Appl. No.: 09/645,130

(22) Filed: Aug. 24, 2000

Related U.S. Application Data

(60) Provisional application No. 60/150,786, filed on Aug. 26, 1999.

(51) Int. Cl.[7] ..... A47F 7/08
(52) U.S. Cl. ..... 211/35
(58) Field of Search ..... 211/35, 34, 36, 211/37, 38, 87.01, 113, 118, 117, 90.01, 88.01

(56) References Cited

U.S. PATENT DOCUMENTS

| | | | | |
|---|---|---|---|---|
| 956,130 | A | 3/1910 | Fellows | |
| 1,377,444 | A | 5/1921 | Shoemaker | 248/304 |
| 1,401,356 | A | 12/1921 | Parchert | |
| 1,404,555 | A * | 1/1922 | Smith | |
| 1,450,948 | A | 4/1923 | Glidden | |
| 1,570,451 | A | 1/1926 | Simoneau | |
| 1,674,359 | A | 6/1928 | Frey | |
| 1,703,190 | A | 2/1929 | Glidden | |
| 1,733,487 | A | 10/1929 | Hackley | |
| 1,769,344 | A | 7/1930 | Hoffmire | |
| 2,090,108 | A | 8/1937 | Cicero | 211/35 |
| 2,157,001 | A | 5/1939 | Morley | 248/206 |
| 2,205,817 | A | 6/1940 | Kramb | 24/259 |
| 2,238,884 | A | 4/1941 | Hoffman | 211/38 |
| 2,299,021 | A | 10/1942 | Hoffman | 211/34 |
| D139,415 | S | 11/1944 | Brown | 211/35 X |
| 2,459,909 | A | 1/1949 | Alofs | 248/303 |
| 2,504,910 | A | 4/1950 | Wellington | 221/89 |
| 2,536,059 | A * | 1/1951 | Igler | |
| D165,942 | S | 2/1952 | Stein | D80/10 |
| 2,620,929 | A | 12/1952 | Sportsman | 211/42 |
| 2,654,487 | A | 10/1953 | Degener | 211/148 |
| 2,682,955 | A | 7/1954 | Moore | 211/35 |
| 2,701,564 | A | 2/1955 | Wilhelm | 128/75 |
| 2,815,862 | A | 12/1957 | Einhorn | 211/37 |
| 2,845,182 | A | 7/1958 | Atkinson | 211/37 |
| 2,911,117 | A | 8/1959 | Plocki et al. | 211/38 |
| 3,022,897 | A * | 2/1962 | Archer et al. | |
| 3,171,542 | A | 3/1965 | Jacobs et al. | 211/43 |
| 3,391,793 | A | 7/1968 | Streuli | 211/43 |
| 3,468,426 | A | 9/1969 | Loewy | 211/35 |
| 3,578,282 | A | 5/1971 | Olsen | 248/214 |
| 3,637,084 | A | 1/1972 | Uitz | 211/105.1 |
| 3,792,804 | A | 2/1974 | Ponzo | 223/85 |
| 3,913,745 | A | 10/1975 | Weiss | 211/34 |
| 3,918,670 | A | 11/1975 | Doherty | 211/35 X |
| 3,999,734 | A | 12/1976 | Gibson et al. | 248/460 |
| 4,094,030 | A | 6/1978 | Saad | 12/116.8 |
| 4,199,070 | A | 4/1980 | Magnussen, Jr. | 211/194 X |
| 4,209,098 | A | 6/1980 | Adams | 211/60 |
| 4,245,746 | A | 1/1981 | Aylor | 211/40 |

(List continued on next page.)

FOREIGN PATENT DOCUMENTS

| | | | |
|---|---|---|---|
| FR | 1 462 095 | 11/1966 | 211/37 |

*Primary Examiner*—Alvin Chin-Shue
*Assistant Examiner*—Sarah Purol
(74) *Attorney, Agent, or Firm*—Shook, Hardy & Bacon L.L.P.

(57) ABSTRACT

A modular storage unit includes at least two of a shoe rack, a basket, a tray, a shelf, and a drawer modularly connected to one another. Each component of the storage unit includes first and second side frame members adapted either to abut against an upright surface to which the unit is attached or to be spatially removed from the upright surface upon attachment by the presence of support feet or the like.

15 Claims, 11 Drawing Sheets

U.S. PATENT DOCUMENTS

| | | | | |
|---|---|---|---|---|
| 4,343,172 | A | 8/1982 | Nordlund | 72/339 |
| 4,457,436 | A | 7/1984 | Kelley | 211/88 |
| 4,463,853 | A | 8/1984 | Licari et al. | 211/37 |
| 4,607,753 | A | 8/1986 | Radek | 211/87 |
| D287,550 | S | 1/1987 | Tocci | D6/315 |
| 4,657,148 | A | 4/1987 | Heng | 211/128 |
| 4,678,151 | A | 7/1987 | Radek | 248/220 |
| 4,688,681 | A | 8/1987 | Bergeron | 211/36 |
| 4,688,687 | A | 8/1987 | Pryor | 211/189 |
| 4,711,419 | A | 12/1987 | Polosky | 248/225 |
| 4,754,885 | A | 7/1988 | Rich | 211/181 |
| 4,805,783 | A | 2/1989 | Mayer | 211/94 |
| 4,825,601 | A | 5/1989 | Halverson | 52/36 |
| 4,899,971 | A | 2/1990 | Elkin | 248/255.1 |
| 4,915,238 | A | 4/1990 | Cassel | 211/37 |
| 4,942,498 | A | 7/1990 | Toussaint | 361/388 |
| 4,981,221 | A | 1/1991 | Davis | 211/37 |
| 5,035,332 | A | 7/1991 | Stravitz | 211/40 |
| 5,048,698 | A | 9/1991 | Konrad | 211/45 |
| 5,054,629 | A | 10/1991 | Breen | 211/128 |
| 5,078,270 | A | 1/1992 | Campbell | 211/194 X |
| 5,082,125 | A | 1/1992 | Ninni | 211/184 |
| 5,097,968 | A | 3/1992 | Gregory | 211/94 |
| 5,101,986 | A | 4/1992 | Holztrager | 211/13 |
| 5,101,989 | A | 4/1992 | Jones | 211/94 |
| 5,103,985 | A | 4/1992 | Davis | 211/37 |
| 5,152,407 | A | 10/1992 | Massoudnia et al. | 211/181 |
| 5,172,816 | A | 12/1992 | Klein | 211/27 |
| D354,412 | S | 1/1995 | Emery | D6/546 |
| D377,728 | S | 2/1997 | Klein et al. | D6/513 |
| 5,641,079 | A | 6/1997 | Schmidt | 211/70.1 |
| D381,225 | S | 7/1997 | Malik | D6/513 |
| D382,434 | S | 8/1997 | Klein et al. | D6/570 |
| 5,695,073 | A | 12/1997 | Klein et al. | 211/35 |
| D398,787 | S | 9/1998 | Malik | D6/411 |
| D403,880 | S | 1/1999 | Malik | D6/411 |
| 5,855,279 | A | 1/1999 | Klein et al. | 211/35 |
| 6,138,841 | A | * 10/2000 | Klein et al. | |

* cited by examiner

HANGING MODULAR STORAGE UNIT

CROSS-REFERENCE TO RELATED APPLICATIONS

The present invention claims priority from U.S. Provisional Application Serial No. 60/150,786, filed Aug. 26, 1999, entitled "Hanging Modular Storage Unit".

STATEMENT REGARDING FEDERALLY SPONSORED RESEARCH OR DEVELOPMENT

BACKGROUND OF THE INVENTION

The present invention relates generally to modular storage racks for attaching to an upright surface, or hanging over a door. More particularly, the present invention relates to modular hanging storage units including a shoe rack, a basket, a tray, shelves, and/or drawers.

DESCRIPTION OF THE RELATED ART

U.S. patent application Ser. No. 08/915,821, filed Aug. 20, 1997, entitled "Clothes Hanger With Sliding Hooks", incorporated herein by reference, teaches a modular hanging storage unit including a shoe rack and a hook unit.

U.S. Pat. No. 5,695,073 teaches a hanging shoe rack having first and second plastic side frame members, and a plurality of shoe-retaining tiers, formed by pairs of support bars, extending there between. U.S. Pat. No. 5,695,073 is incorporated herein by reference in its entirety. U.S. Pat. No. 5,695,073 illustrates and describes a modular hanging shoe rack, such that one shoe rack may be modularly connected to another shoe rack.

SUMMARY OF THE INVENTION

The present invention is directed to a modular storage unit, including in one embodiment a shoe rack, modularly connected to a different type of storage unit. In particular, the present invention provides a modular storage unit comprising at least two of the following: shoe rack, basket, tray, shelves, and drawer.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
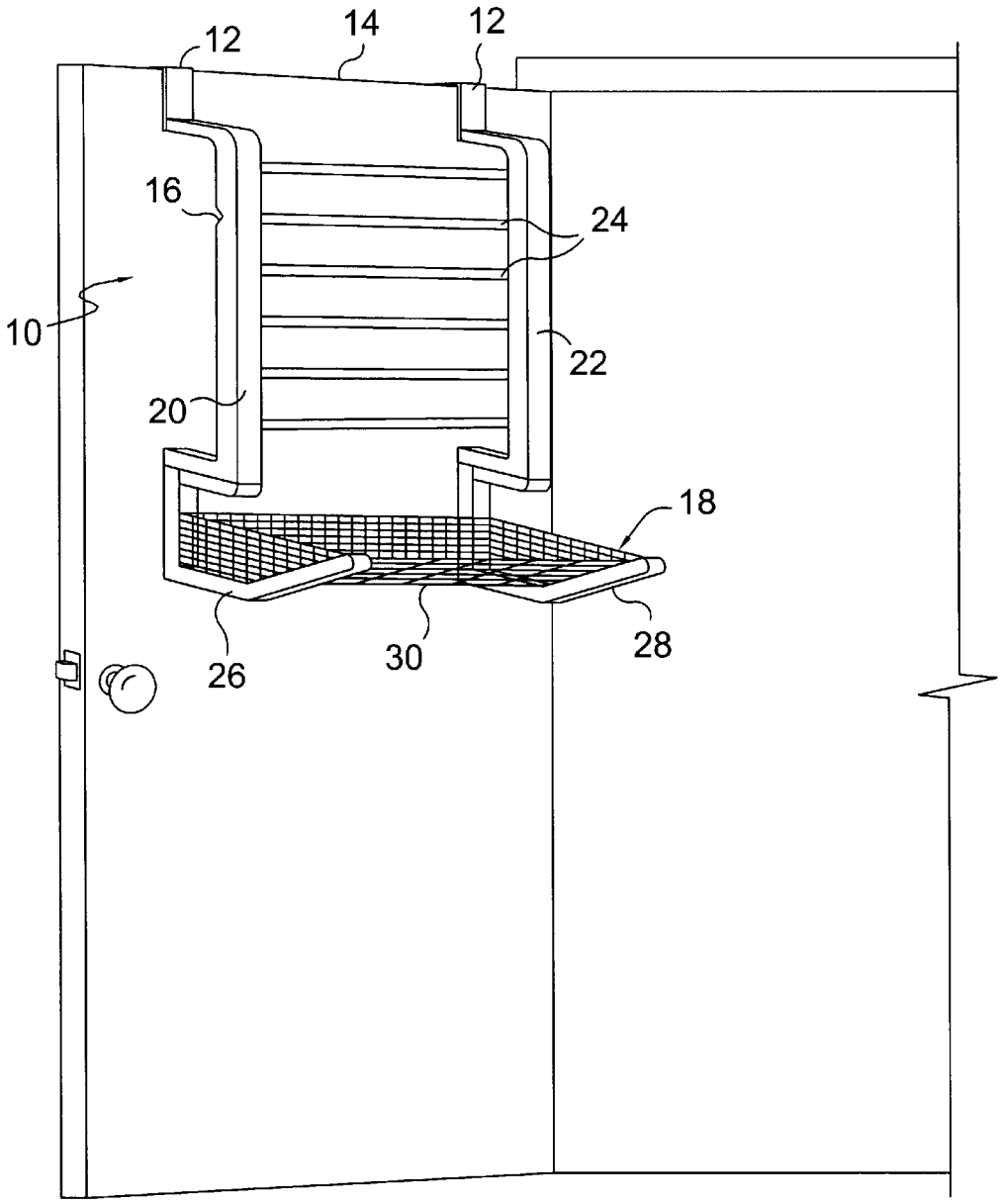
FIG. 1 is a perspective view of a first embodiment of a modular storage unit of the present invention, illustrating a modular shoe rack and basket.

With reference initially to FIG. 1, a modular storage unit of the present invention is denoted generally by reference numeral 10. In particular, modular storage unit 10 hangs from hangers 12 over a door 14 in a manner such as that set forth in U.S. Pat. No. 5,695,073. Modular unit 10 of this embodiment combines a shoe rack 16 and a basket 18. In particular, the shoe rack 16 has first and second side frame members, preferably made of plastic or steel, denoted by reference numerals 20, 22. A plurality of support tubes or wires, denoted by reference numeral 24, form tiers for retaining shoes. Basket 18 itself has a pair of side frame members 26, 28, preferably formed of molded plastic, and a basket portion 30, which is preferably formed of meshed wire or plastic. The basket 14 modularly connects to a bottom of the shoe rack 16 by the presence of mating male and female members on the respective units. In particular, the preferred manner of connecting the basket 18 to the shoe rack 16 is illustrated in U.S. Pat. No. 5,695,073, which illustrates two shoe racks being modularly connected together with male and female members.

Figure 2:
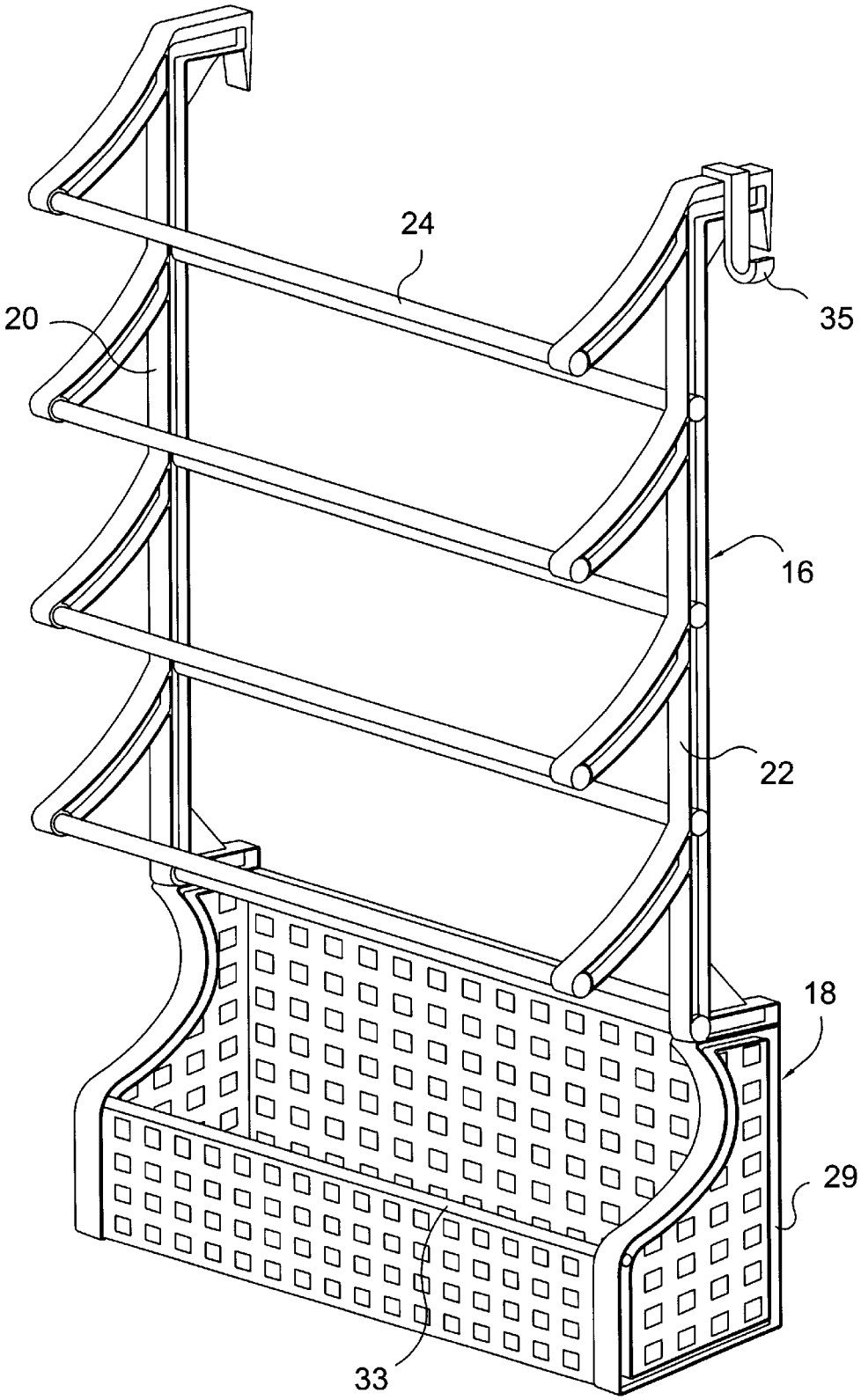
FIG. 2 is a perspective view of a second embodiment of a modular storage unit of the present invention, illustrating a modular shoe rack and basket.

With reference to FIG. 2, an alternative embodiment of the first embodiment is illustrated, wherein the basket 18 has a different configuration. Basket 18 is formed of a plastic "mesh" material which snaps into place between first and second side frame members 29. The front uppermost edge 33 of basket 18 is formed of a plastic tube which is adapted to fit snugly between the sides of basket 18, aiding in retaining the shape and adding to the structural integrity of the basket. FIG. 2 also illustrates the use of side hooks 35 which are adapted to snap into place on the upper portion of side frame members 20, 22. In this embodiment, clothing, towels and the like may be stored on side hooks 35.

Figure 3:
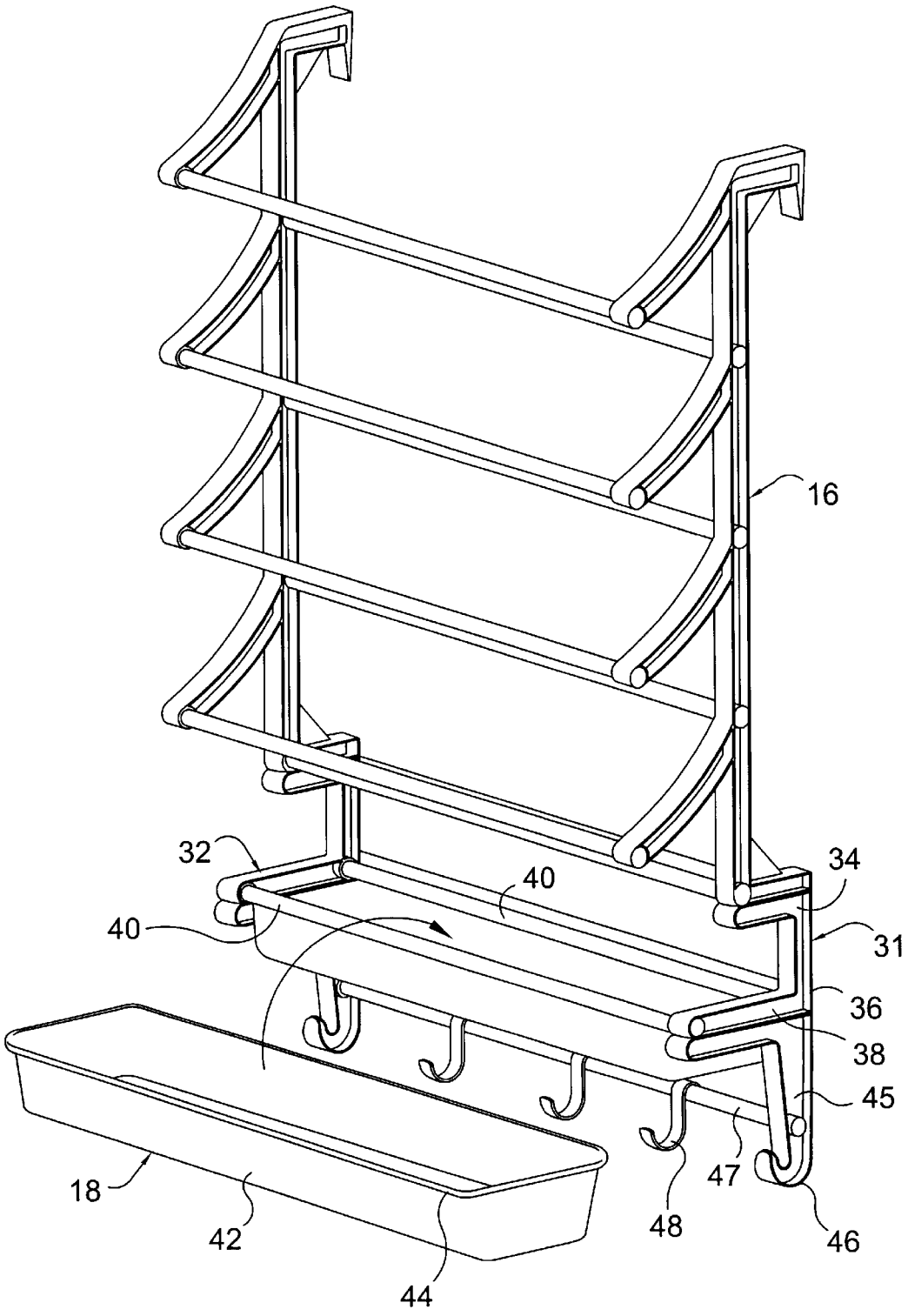
FIG. 3 is a perspective view of a third embodiment of a modular storage unit of the present invention, illustrating a modular shoe rack and tray arrangement.

In the embodiment of FIG. 3, the basket 18 takes on yet another configuration. In particular, in the embodiment of FIG. 3, a pair of plastic side frame members 31, 32 have an upper portion 34, a downwardly dependent portion 36, and an outwardly extending portion 38. The upper portion 34 has connectors thereon for mating with a lower potion of the shoe rack 16. In particular, upper portion 34 preferably has female channels for receiving male members on the shoe rack, as is clearly illustrated and described in U.S. Pat. No. 5,695,073, incorporated herein by reference.

Extending portion 38 of side frame members 31, 32 have a pair of sockets for receiving rods 40. Rods 40 are spaced so as to receive there between a main body portion 42 of basket 18, which is preferably formed of plastic. The basket 18 has an upper, an outwardly extending peripheral rim 44 which is adapted to rest on top of, and in fact curl about, each of the rods 40, thereby suspending the basket 18 on the rods 40. Additionally, in a variation of this embodiment, plastic side frame members 30, 32 may also have a downwardly depending arm 45, having a hook 46 at a bottom end thereof. Additionally, one or more rods 47 may extend between the downwardly depending arms 45 for supporting hooks or slidable hooks 48 thereon.

Figure 4:
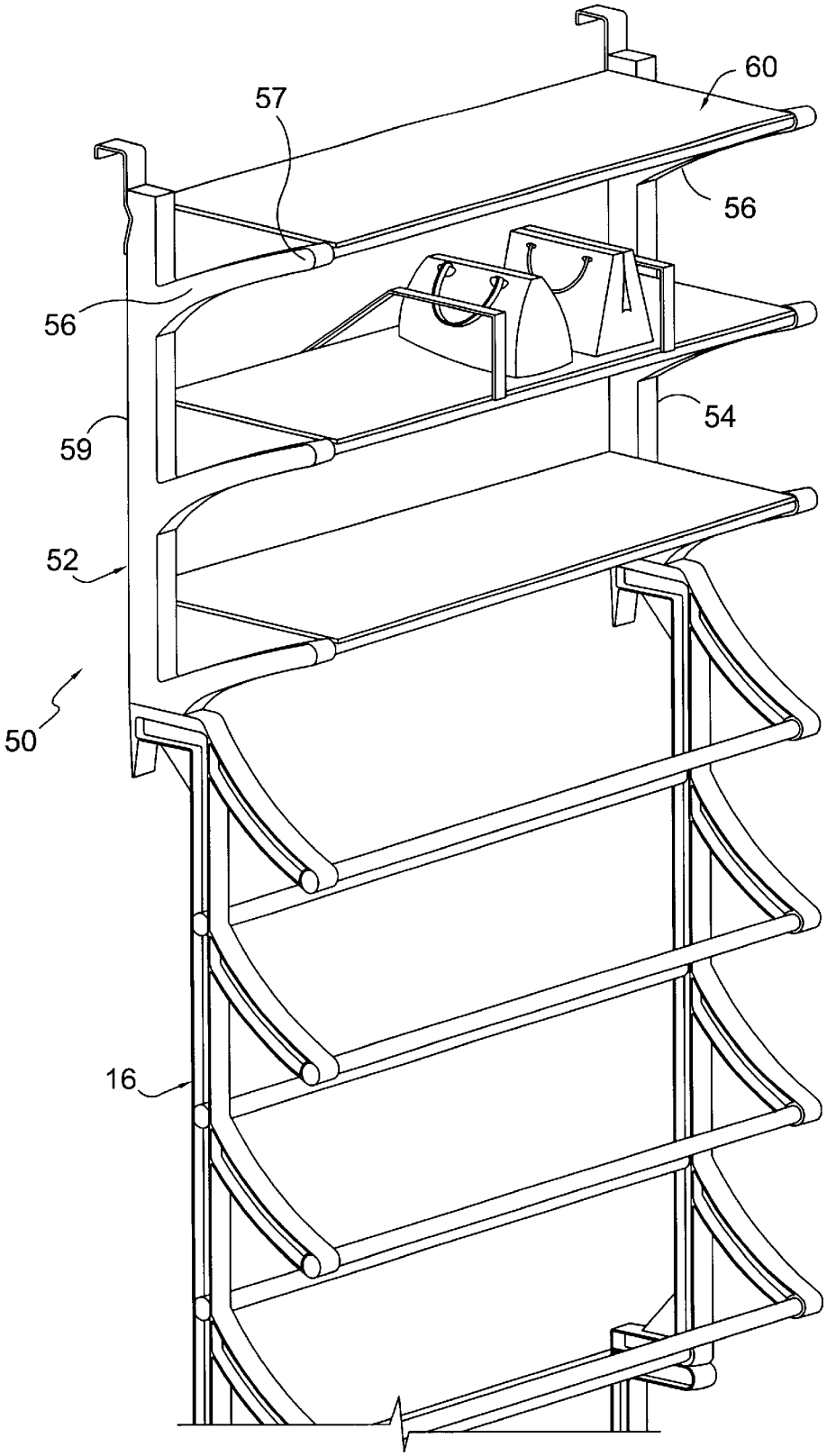
FIG. 4 is a perspective view of a fourth embodiment of a modular storage unit of the present invention, illustrating a modular shoe rack and shelving arrangement.
Figure 5:
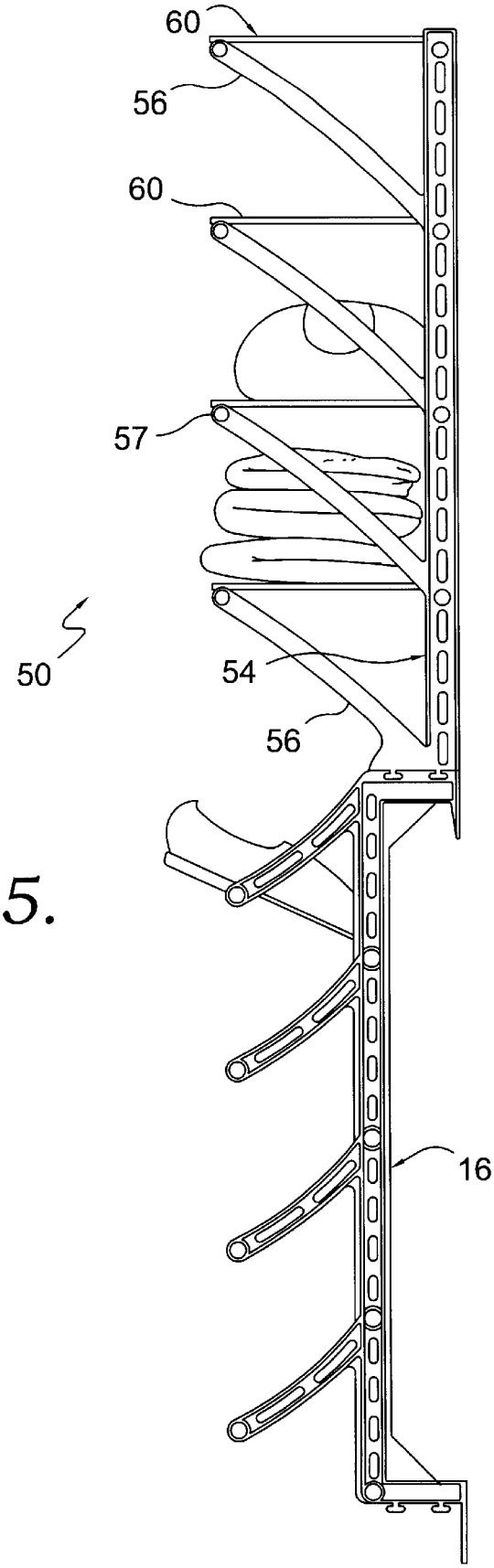
FIG. 5 is a perspective view of a fifth embodiment of a modular storage unit of the present invention, illustrating a modular shoe rack and shelving arrangement.

With reference to FIGS. 4 and 5, the modular storage unit of this embodiment of the present invention combines a shoe rack 16 and a shelving arrangement 50. Shelving arrangement 50 preferably has first and second side frame members 52, 54 having outwardly and upwardly extending support arms 56 thereon. Tubes are positioned between the side frame members 52 and 54 proximate the outer ends 57 of each arm, as well as between the main structural portion 59 of the respective side frame members 52, 54, such that shelves 60 may rest thereon. Particularly, and preferably, each shelf 60 wraps around outer portions of the corresponding rods upon which it rests, thereby securing the shelf 60 in place on the unit. In the embodiment of FIGS. 4 and 5, the main structural portion 59 preferably abuts up against the upright surface (e.g., door) upon which the unit is mounted.

Figures 6, 6A, 6B:
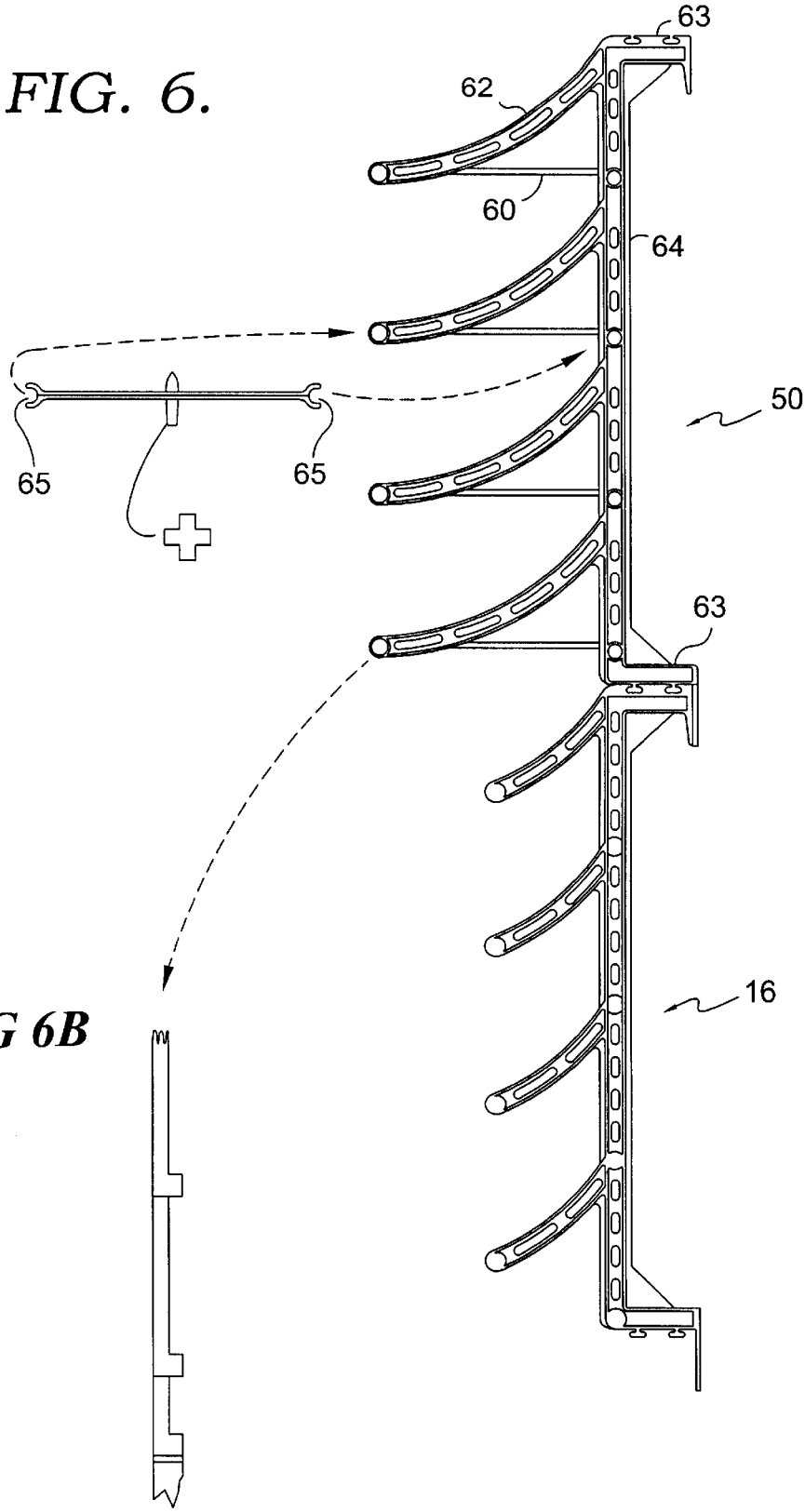
FIG. 6 is a perspective view of an alternate embodiment of that which is illustrated in FIG. 5.
FIG. 6*a* is illustrative of a shelf used in conjunction with the present invention.
FIG. 6*b* is a fragmentary, front view of the shelf portion of the embodiment of FIG. 6.

In the embodiment of FIG. 6, the shelving arrangement 50 differs from the previously described embodiment in that arms 62 depend outwardly and downwardly from a main vertical section 64 of the respective side frame members of the shelving arrangement 50. Additionally, in a variation of the shelf arrangement, the shelf may be of a grid type, as illustrated in FIG. 6a and may include semicircular channels 65 at an outer end thereof for embracing with corresponding rods on the unit 50. In each of the embodiments of FIGS. 4–6, the arms 56, 62 serve to prevent lateral movement of items stored on the shelves 60. Additionally, in the embodiment of FIG. 6, the vertical member 64 is positioned outwardly (e.g., spatially removed) from the upright surface upon which the shelving arrangement 50 is mounted. This is accomplished by the provision of leg portions 63. Additionally, although not illustrated, the shelves 60 may have peripheral rims for retaining items thereon and/or may be slanted downwardly toward the upright surface to assist in retention of articles on the shelf.

Figure 7:
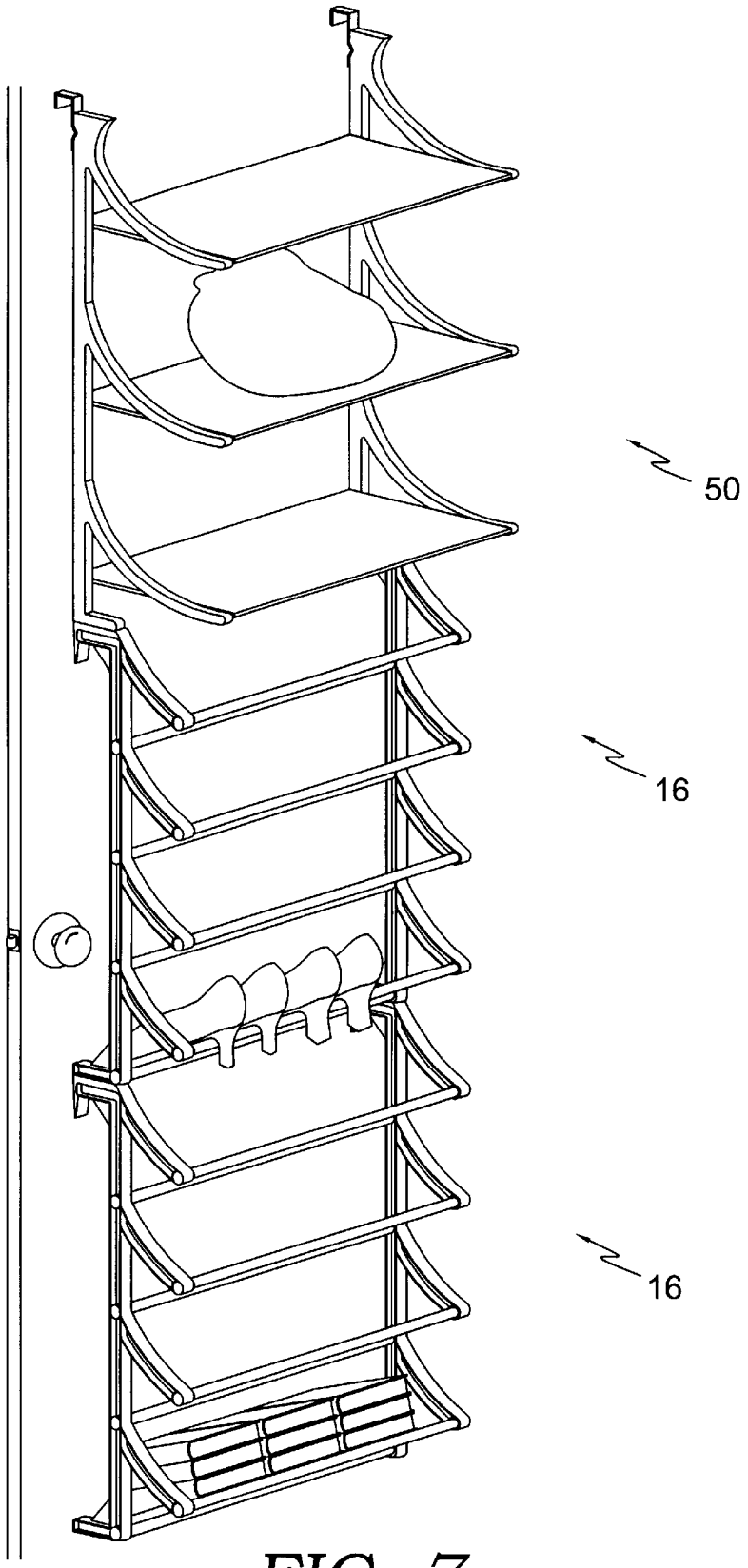
FIG. 7 is a front left perspective view of a modular, hanging shelf and shoe rack unit of the present invention.

FIG. 7 illustrates, in a perspective view, a combined modular unit combining a shelving arrangement 50 and a pair of shoe racks 16.

Figure 8:
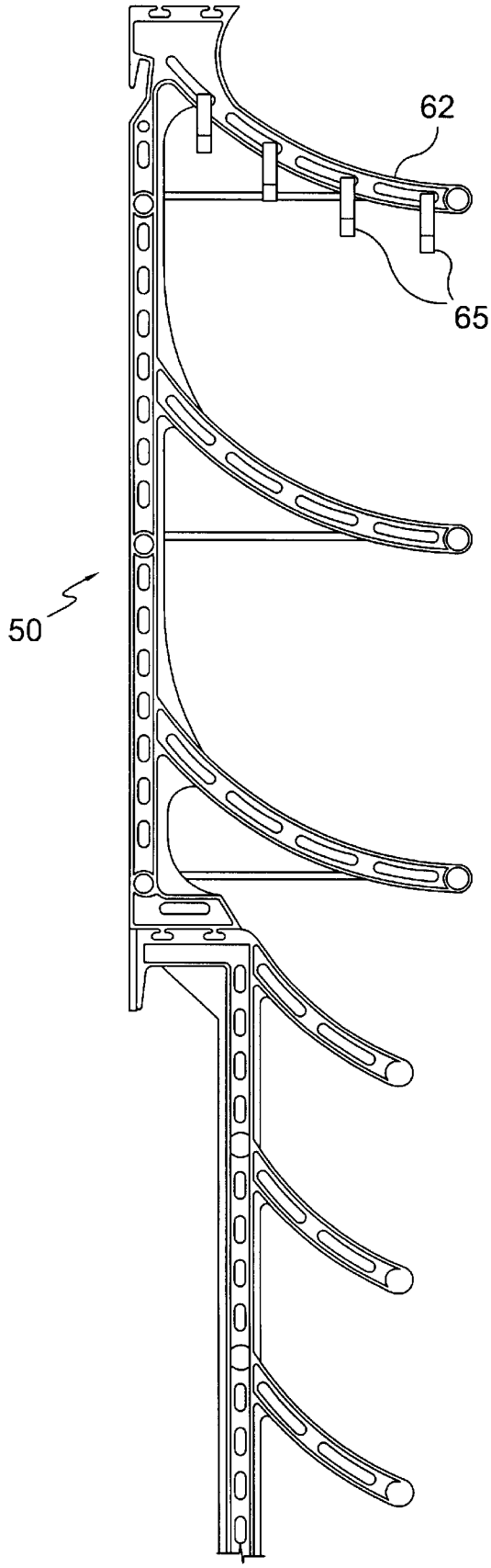
FIG. 8 is a left side view of a modular shelf and shoe rack unit of the present invention, including hooks.

In the embodiment of FIG. 8, a plurality of hooks 65 are provided on one or more of the support arms 62 of a shelf unit 50.

Figure 9:
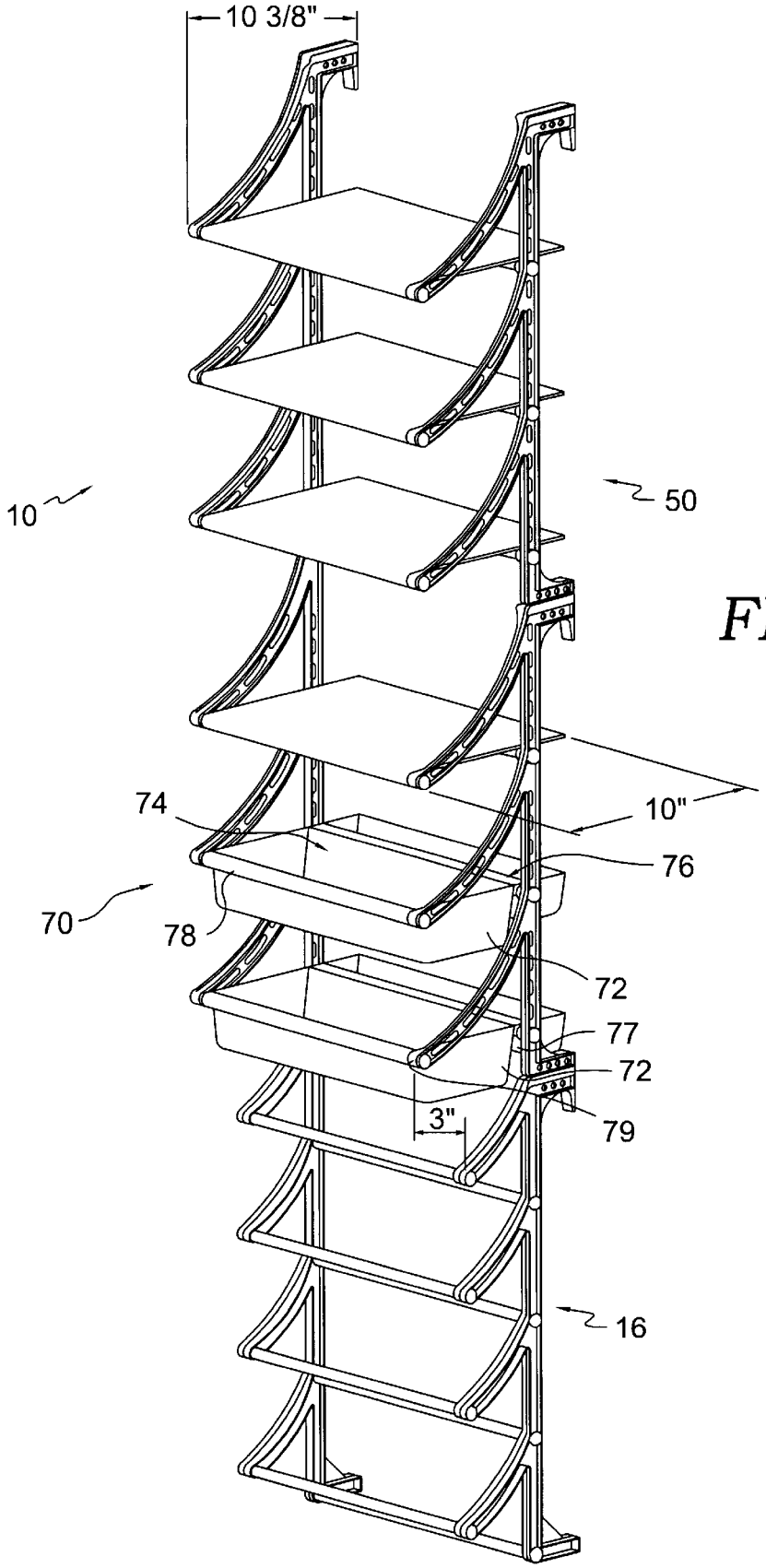
FIG. 9 is a right perspective view of a modular unit of the present invention combining shelves, trays, and a shoe rack.

In the embodiment of FIG. 9, a modular storage unit 10 of the present invention includes a shelf unit 50, a shoe rack 16, and a compartment tray unit 70. In particular, the compartment tray unit is constructed similarly to the shelving arrangement 50, with the exception that it has two-compartment trays 72 positioned thereon. In particular, each compartment tray 72 has first and second compartments 74, 76, separated by walls which form a recessed area 77 at the bottom of the tray 72. As illustrated, each recessed area receives the rearmost rod on the storage unit. Preferably, a frontal, upper portion of each tray has an outwardly and downwardly curled lip 78 for wrapping about an outermost one of the support rods, denoted in FIG. 9 by reference numeral 79. Preferably each support rod is tubular and is approximately 15 inches in length. As illustrated, the various units 50, 70, and 16 modularly connect to each other with connectors and, particularly, with male/female connectors, as illustrated and described in U.S. Pat. No. 5,695,073, incorporated hereby by reference.

Figure 10:
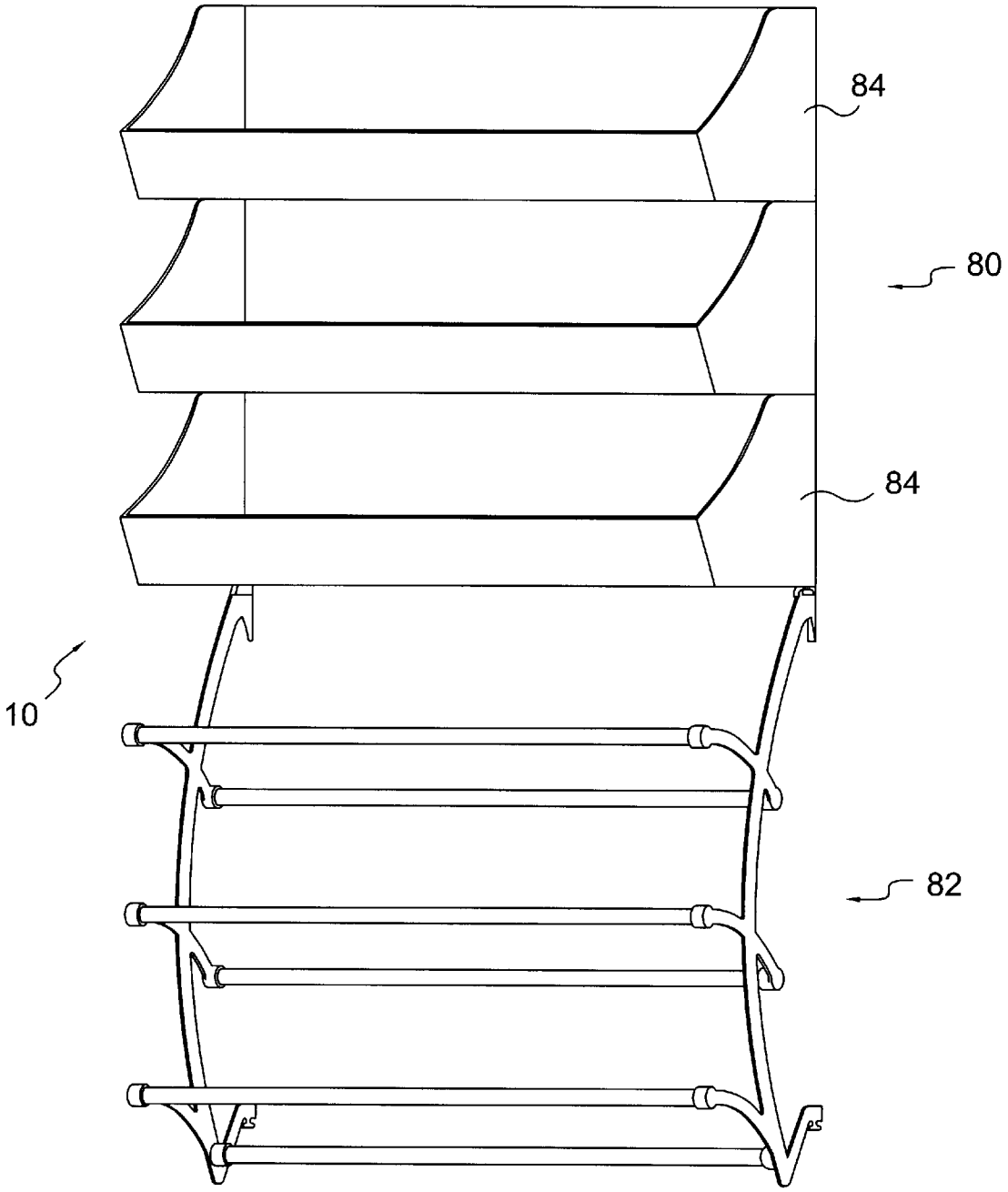
FIG. 10 is a right perspective view of a modular unit of the present invention combining storage bins and a shoe rack.

In the embodiment of FIG. 10 of the present invention, the modular hanging storage unit 10 of the present invention combines a storage bin unit 80 with a shoe rack 82. The illustrated shoe rack 82 is constructed differently than those previously described, but nevertheless employs first and second side frame members with a plurality of shoe retaining bars there between. The storage bin unit 80 has a plurality of storage bins 84. As will be understood and appreciated, the entire unit may be secured to an upright surface through fasteners or, alternatively, the storage bin unit 80 is preferably provided with components for securing to a hanger mounting over a door in a conventional fashion.

Figure 11:
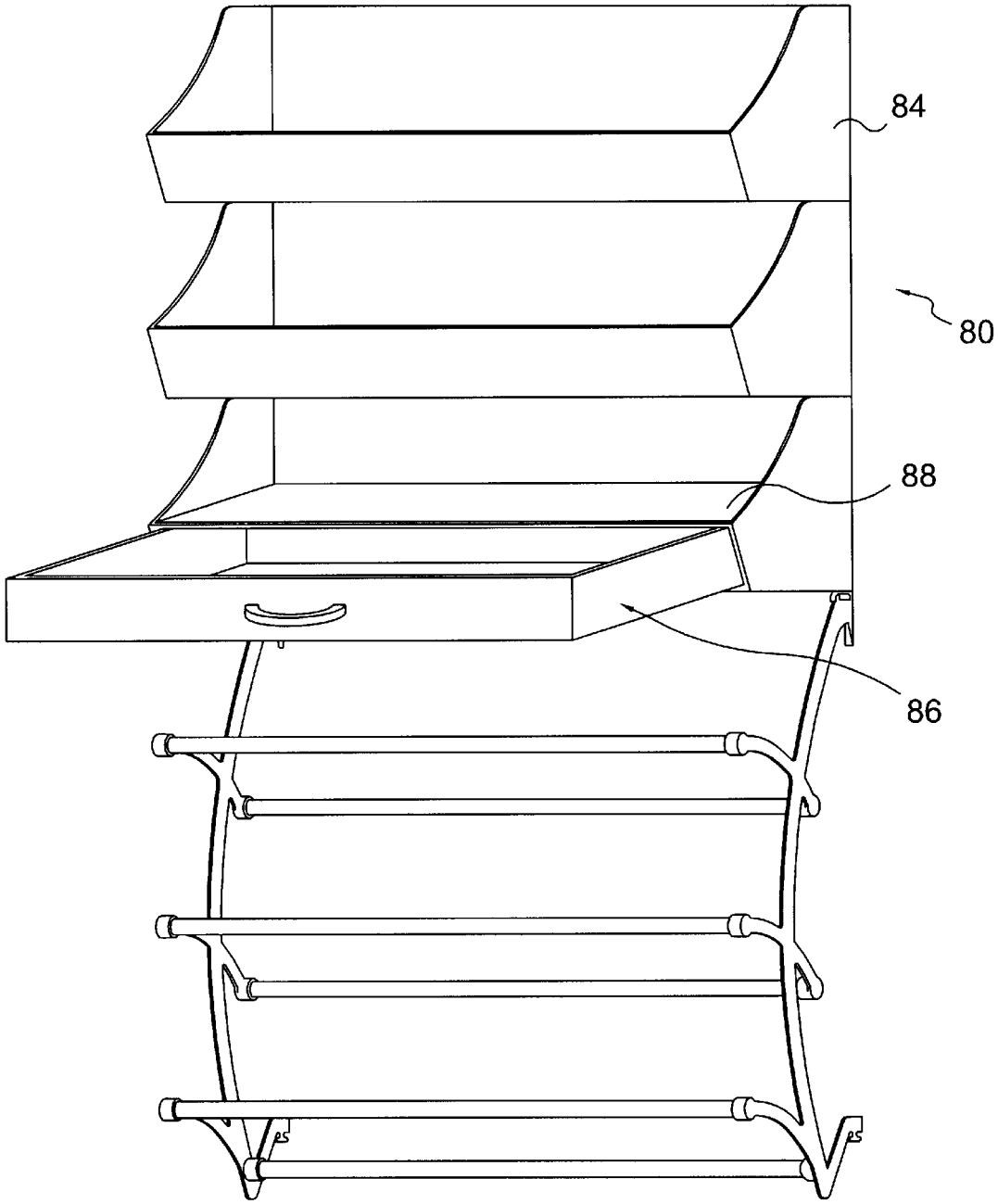
FIG. 11 is a right perspective view of a modular storage unit of the present invention combining storage bins, shelving, a drawer, and a shoe rack.

In the embodiment of FIG. 11, an alternative embodiment is illustrated in which the storage bin unit 80 has been modified to include at least one drawer 86 with corresponding shelf 88. Drawer 86 is constructed to slide in and out with shelf 88 covering the top of the drawer and sheltering the contents therein.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A modular hanging storage unit comprising:

a shoe rack having opposite frame sides and a plurality of cross supports forming tiers for retaining shoes; and a basket modularly connected thereto, said basket having a pair of side frames connected with said frame sides of the shoe rack and a mesh construction supported on said side frames.

2. A modular hanging storage unit comprising:

a shoe rack having opposite frame sides and a plurality of cross supports forming tiers for retaining shoes; and a tray unit modularly connected thereto, said tray unit having a frame connected with said frame sides of the shoe rack and including support bars, and an open top container presenting a rim thereon adapted to rest on said support bars to removably mount said container on said frame of the tray unit.

3. The modular hanging storage unit as set forth in claim 2, wherein the tray unit further comprises at least one hook.

4. A modular hanging storage unit comprising:

a shoe rack having opposite frame sides and a plurality of cross supports forming tiers for retaining shoes; and a shelf unit having side frame members with a first set of tubes extending therebetween and arms extending away from said side frame members with a second set of tubes extending between said arms, and a generally flat shelf having portions wrapping on said tubes in said first and second sets of tubes to secure the shelf in place.

5. A modular hanging storage unit comprising:

a storage bin unit including a plurality of storage bins spaced apart one above the other; and a shoe rack presenting a plurality of tiers for holding shoes.

6. A modular hanging storage unit comprising:

a shoe rack; and a drawer unit including a drawer constructed to slide in and out and a shelf covering said drawer when the drawer is slid in.

7. A hanging storage unit comprising:

first and second side frame members, at least one pair of support bars extending laterally between said first and second side frame members; and a tray unit suspended from said support bars.

8. A hanging storage unit as set forth in claim 9, wherein said tray unit comprises a two-compartment tray, wherein one of said compartments is positioned in front of one of the said support bars, and the other of said compartments is positioned behind said one support bar.

9. A modular hanging storage unit comprising:

a shelf unit; and a basket.

10. A modular hanging storage unit comprising:

a shelf unit; and a tray unit.

11. A modular hanging storage unit comprising:

a shelf unit; and a storage bin unit.

12. a modular hanging storage unit comprising:

a drawer unit; and a basket.

13. A modular hanging storage unit comprising:

a drawer unit; and a tray unit.

14. A modular hanging storage unit comprising at least three storage units selected from the group consisting of a shoe rack, a shelf unit, a basket, a tray unit, a storage bin unit, and a drawer.

15. A modular hanging storage unit as set forth in claim 1, wherein said basket has a front uppermost edge in the form of a tube extending between said side frames of the basket.

* * * * *